US007123731B2

(12) United States Patent
Cohen et al.

(10) Patent No.: US 7,123,731 B2
(45) Date of Patent: Oct. 17, 2006

(54) SYSTEM AND METHOD FOR OPTIMIZATION OF THREE-DIMENSIONAL AUDIO

(75) Inventors: Yuval Cohen, Rehovot (IL); Amir Bar On, Rehovot (IL); Giora Naveh, Rehovot (IL)

(73) Assignee: BE4 Ltd., Rehovot (IL)

( * ) Notice: Subject to any disclaimer, the term of this patent is extended or adjusted under 35 U.S.C. 154(b) by 221 days.

(21) Appl. No.: 10/220,969

(22) PCT Filed: Mar. 7, 2001

(86) PCT No.: PCT/IL01/00222

§ 371 (c)(1),
(2), (4) Date: Sep. 5, 2002

(87) PCT Pub. No.: WO01/67814

PCT Pub. Date: Sep. 13, 2001

(65) Prior Publication Data

US 2003/0031333 A1 Feb. 13, 2003

(30) Foreign Application Priority Data

Mar. 9, 2000 (IL) ..... 134979

(51) Int. Cl.
*H04R 5/02* (2006.01)

(52) U.S. Cl. ..... 381/303; 381/103; 381/58

(58) Field of Classification Search ..... 381/300, 381/303, 103, 58, 59

See application file for complete search history.

(56) References Cited

U.S. PATENT DOCUMENTS 4,739,513 A * 4/1988 Kunugi et al. ..... 381/103
4,823,391 A * 4/1989 Schwartz ..... 381/103
5,181,248 A 1/1993 Inanaga et al. ..... 381/25
5,255,326 A 10/1993 Stevenson ..... 381/110

(Continued)

FOREIGN PATENT DOCUMENTS

DE 26 52 101 5/1978

(Continued)

OTHER PUBLICATIONS

Abstract of JP 09-238390, *Patent Abstracts of Japan*, 1997.

(Continued)

*Primary Examiner*—Brian T. Pendleton
(74) *Attorney, Agent, or Firm*—Ladas & Parry LLP

(57) ABSTRACT

The invention provides a system for optimization of three-dimensional audio listening having a media player and a multiplicity of speakers disposed within a listening space, the system including a portable sensor having a multiplicity of transducers strategically arranged about the sensor for receiving test signals from the speakers and for transmitting the signals to a processor connectable in the system for receiving multi-channel audio signals from the media player and for transmitting the multi-channel audio signals to the multiplicity of speakers, the processor including (a) means for initiating transmission of test signals to each of the speakers and for receiving the test signals from the speakers to be processed for determining the location of each of the speakers relative to a listening place within the space determined by the placement of the sensor; (b) means for manipulating each sound track of the multi-channel sound signals with respect to intensity, phase and/or equalization according to the relative location of each speaker in order to create virtual sound sources in desired positions, and (c) means for communicating between the sensor and the processor. The invention further provides a method for the optimization of three-dimensional audio listening using the above-described system.

12 Claims, 7 Drawing Sheets

U.S. PATENT DOCUMENTS

| | | | | |
|---|---|---|---|---|
| 5,386,478 | A | 1/1995 | Plunkett | 381/103 |
| 5,452,359 | A | 9/1995 | Inanaga et al. | 381/25 |
| 5,495,534 | A | 2/1996 | Inanaga et al. | 381/25 |
| 5,572,443 | A * | 11/1996 | Emoto et al. | 702/103 |
| 6,118,880 | A * | 9/2000 | Kokkosoulis et al. | 381/303 |
| 6,469,732 | B1 * | 10/2002 | Chang et al. | 348/14.08 |
| 6,639,989 | B1 * | 10/2003 | Zacharov et al. | 381/303 |
| 2002/0025053 | A1 * | 2/2002 | Lydecker et al. | 381/303 |

FOREIGN PATENT DOCUMENTS

| | | |
|---|---|---|
| DE | 43 32 504 A1 | 3/1995 |
| EP | 0 100 153 A2 | 2/1984 |
| EP | 0 438 281 A2 | 7/1991 |
| EP | 0 438 281 A3 | 7/1991 |
| EP | 0 438 281 B1 | 7/1991 |
| EP | 0 705 053 A2 | 4/1996 |
| FR | 2 337 386 | 2/1975 |
| JP | 42-227 | 1/1942 |
| JP | 54-19242 | 7/1979 |
| JP | 09-238390 | 9/1997 |

OTHER PUBLICATIONS

Abstract of JP 54-19242, *Patent Abstracts of Japan*, (2000).

* cited by examiner

SYSTEM AND METHOD FOR OPTIMIZATION OF THREE-DIMENSIONAL AUDIO

FIELD OF THE INVENTION

The present invention relates generally to a system and method for personalization and optimization of three-dimensional audio. More particularly, the present invention concerns a system and method for establishing a listening sweet spot within a listening space in which speakers are already located.

BACKGROUND OF THE INVENTION

It is a fact that surround and multi-channel sound tracks are gradually replacing stereo as the preferred standard of sound recording. Today, many new audio devices are equipped with surround capabilities. Most new sound systems sold today are multi-channel systems equipped with multiple speakers and surround sound decoders. In fact, many companies have devised algorithms that modify old stereo recordings so that they will sound as if they were recorded in surround. Other companies have developed algorithms that upgrade older stereo systems so that they will produce surround-like sound using only two speakers. Stereo-expansion algorithms, such as those from SRS Labs and Spatializer Audio Laboratories, enlarge perceived ambiance; many sound boards and speaker systems contain the circuitry necessary to deliver expanded stereo sound.

Three-dimensional positioning algorithms take matters a step further seeking to place sounds in particular locations around the listener, i.e., to his left or right, above or below, all with respect to the image displayed. These algorithms are based upon simulating psycho-acoustic cues replicating the way sounds are actually heard in a 360° space, and often use a Head-Related Transfer Function (HRTF) to calculate sound heard at the listener's ears relative to the spatial coordinates of the sound's origin. For example, a sound emitted by a source located to one's left side is first received by the left ear and only a split second later by the right ear. The relative amplitude of different frequencies also varies, due to directionality and the obstruction of the listener's own head. The simulation is generally good if the listener is seated in the "sweet spot" between the speakers.

In the consumer audio market, stereo systems are being replaced by home theatre systems, in which six speakers are usually used. Inspired by commercial movie theatres, home theatres employ 5.1 playback channels comprising five main speakers and a sub-woofer. Two competing technologies, Dolby Digital and DTS, employ 5.1 channel processing. Both technologies are improvements of older surround standards, such as Dolby Pro Logic, in which channel separation was limited and the rear channels were monaural.

Although 5.1 playback channels improve realism, placing six speakers in an ordinary living room might be problematic. Thus, a number of surround synthesis companies have developed algorithms specifically to replay multi-channel formats such as Dolby Digital over two speakers, creating virtual speakers that convey the correct spatial sense. This multi-channel virtualization processing is similar to that developed for surround synthesis. Although two-speaker surround systems have yet to match the performance of five-speaker systems, virtual speakers can provide good sound localization around the listener.

All of the above-described virtual surround technologies provide a surround simulation only within a designated area within a room, referred to as a "sweet spot." The sweet spot is an area located within the listening environment, the size and location of which depends on the position and direction of the speakers. Audio equipment manufacturers provide specific installation instructions for speakers. Unless all of these instructions are fully complied with, the surround simulation will fail to be accurate. The size of the sweet spot in two-speaker surround systems is significantly smaller than that of multi-channel systems. As a matter of fact, in most cases, it is not suitable for more than one listener.

Another common problem, with both multi-channel and two-speaker sound systems, is that physical limitations such as room layout, furniture, etc., prevent the listener from following placement instructions accurately.

In addition, the position and shape of the sweet spot are influenced by the acoustic characteristics of the listening environment. Most users have neither the mean nor the knowledge to identify and solve acoustic problems.

Another common problem associated with audio reproduction is the fact that objects and surfaces in the room might resonate at certain frequencies. The resonating objects create a disturbing hum or buzz.

Thus, it is desirable to provide a system and method that will provide the best sound simulation while disregarding the listener's location within the sound environment and the acoustic characteristics of the room. Such a system should provide optimal performance automatically, without requiring alteration of the listening environment.

DISCLOSURE OF THE INVENTION

Thus, it is an object of the present invention to provide a system and method for locating the position of the listener and the position of the speakers within a sound environment. In addition, the invention provides a system and method for processing sound in order to resolve the problems inherent in such positions.

In accordance with the present invention, there is therefore provided a system for optimization of three-dimensional audio listening having a media player and a multiplicity of speakers disposed within a listening space, said system comprising a portable sensor having a multiplicity of transducers strategically arranged about said sensor for receiving test signals from said speakers and for transmitting said signals to a processor connectable in the system for receiving multi-channel audio signals from said media player and for transmitting said multi-channel audio signals to said multiplicity of speakers; said processor including (a) means for initiating transmission of test signals to each of said speakers and for receiving said test signals from said speakers to be processed for determining the location of each of said speakers relative to a listening place within said space determined by the placement of said sensor; (b) means for manipulating each sound track of said multi-channel sound signals with respect to intensity, phase and/or equalization, according to the relative location of each speaker in order to create virtual sound sources in desired positions, and (c) means for communicating between said sensor and said processor.

The invention further provides a method for optimization of three-dimensional audio listening using a system including a media player, a multiplicity of speakers disposed within a listening space, and a processor, said method comprising selecting a listener sweet spot within said listening space; electronically determining the distance between said sweet spot and each of said speakers, and operating each of said speakers with respect to intensity, phase and/or equalization in accordance with its position relative to said sweet spot.

The method of the present invention measures the characteristics of the listening environment, including the effects of room acoustics. The audio signal is then processed so that its reproduction over the speakers will cause the listener to feel as if he is located exactly within the sweet spot. The apparatus of the present invention virtually shifts the sweet spot to surround the listener, instead of forcing the listener to move inside the sweet spot. All of the adjustments and processing provided by the system render the best possible audio experience to the listener.

The system of the present invention demonstrates the following advantages:

1) the simulated surround effect is always best;
2) the listener is less constrained when placing the speakers;
3) the listener can move freely within the sound environment, while the listening experience remains optimal;
4) there is a significant reduction of hums and buzzes generated by resonating objects;
5) the number of acoustic problems caused by the listening environment is significantly reduced, and
6) speakers that comprise more than one driver would better reassemble a point sound source.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic diagram of an ideal positioning of the loudspeakers relative to the listener's sitting position;

FIG. 2 is a schematic diagram illustrating the location and size of the sweet spot within a sound environment;

FIG. 3 is a schematic diagram of the sweet spot and a listener seated outside it;

FIG. 4 is a schematic diagram of a deformed sweet spot caused by misplacement of the speakers;

FIG. 5 is a schematic diagram of a deformed sweet spot caused by misplacement of the speakers, wherein a listener is seated outside the deformed sweet spot;

FIG. 6 is a schematic diagram of a PC user located outside a deformed sweet spot caused by the misplacement of the PC speakers;

FIG. 7 is a schematic diagram of a listener located outside the original sweet spot and a remote sensor causing the sweet spot to move towards the listener;

FIG. 8 is a schematic diagram illustrating a remote sensor;

Figure 9A:
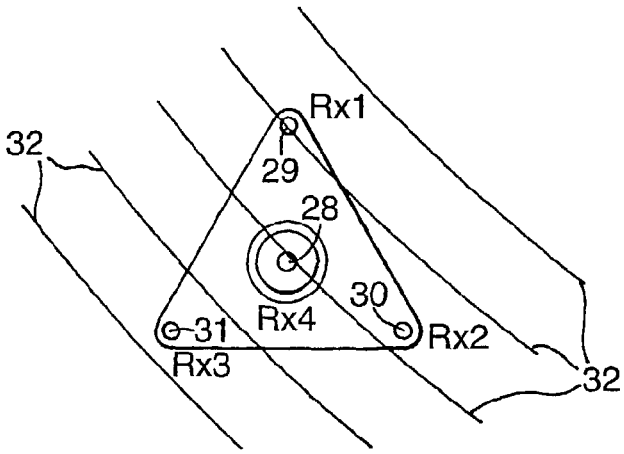
Figure 9B:
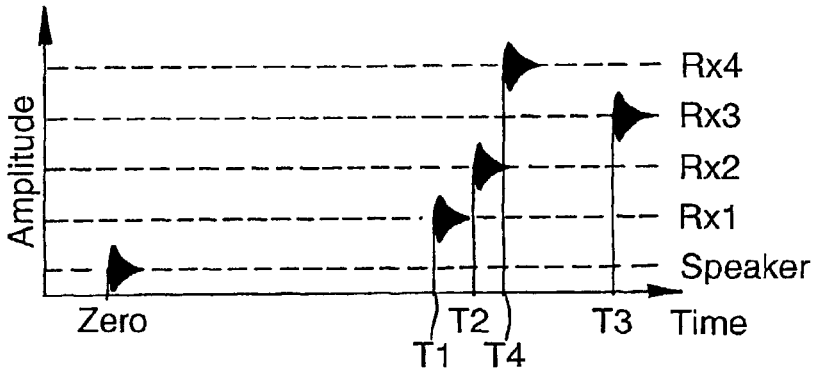
Figure 10:
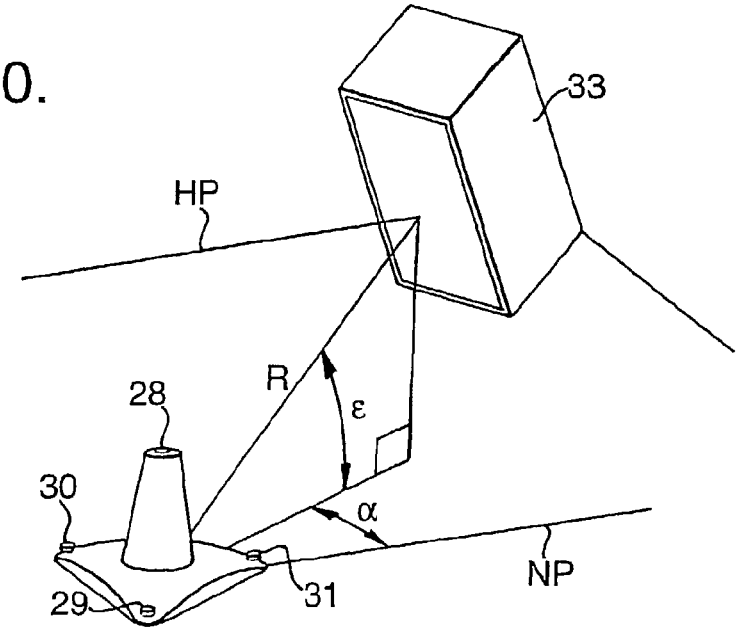
Figure 11:
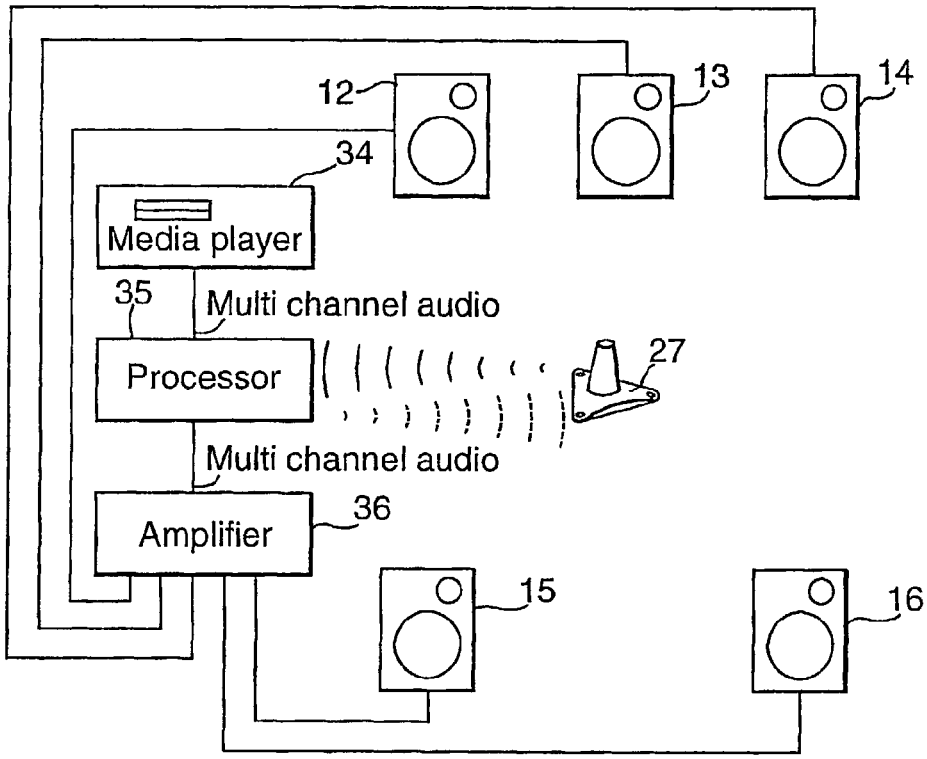
Figure 12:
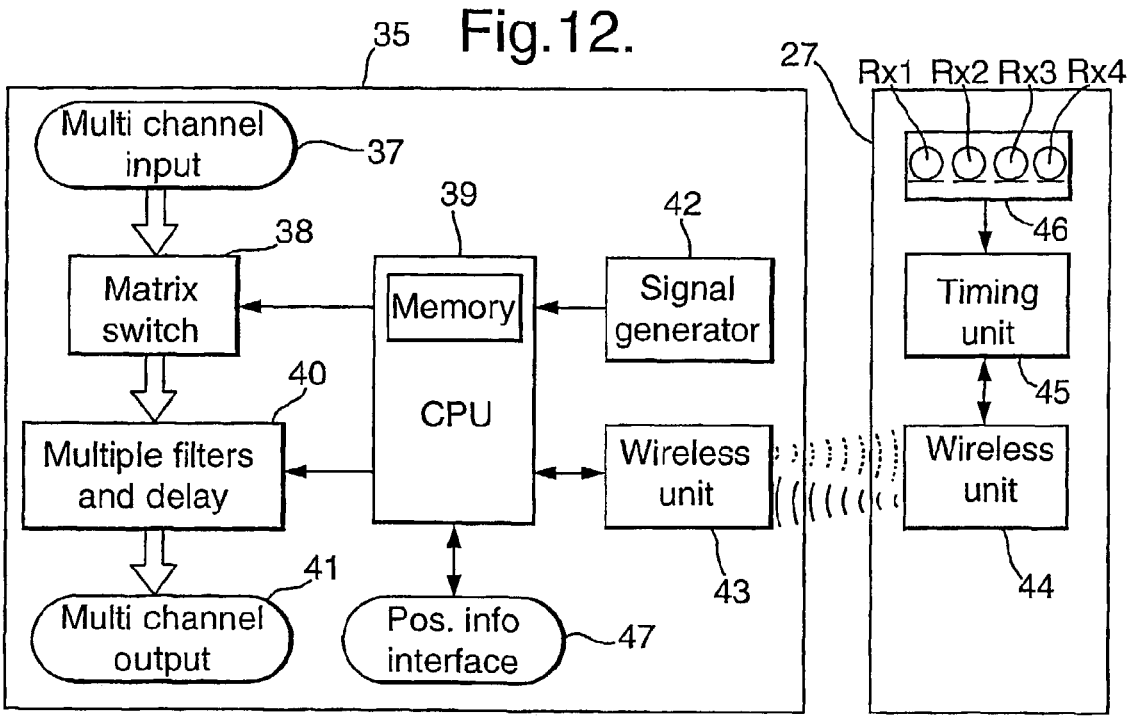

FIG. 9*a* is a schematic diagram illustrating the delay in acoustic waves sensed by the remote sensor's microphones;

FIG. 9*b* is a timing diagram of signals received by the sensor;

FIG. 10 is a schematic diagram illustrating positioning of the loudspeaker with respect to the remote sensor;

FIG. 11 is a schematic diagram showing the remote sensor, the speakers and the audio equipment;

FIG. 12 is a block diagram of the system's processing unit and sensor, and

Figure 13:
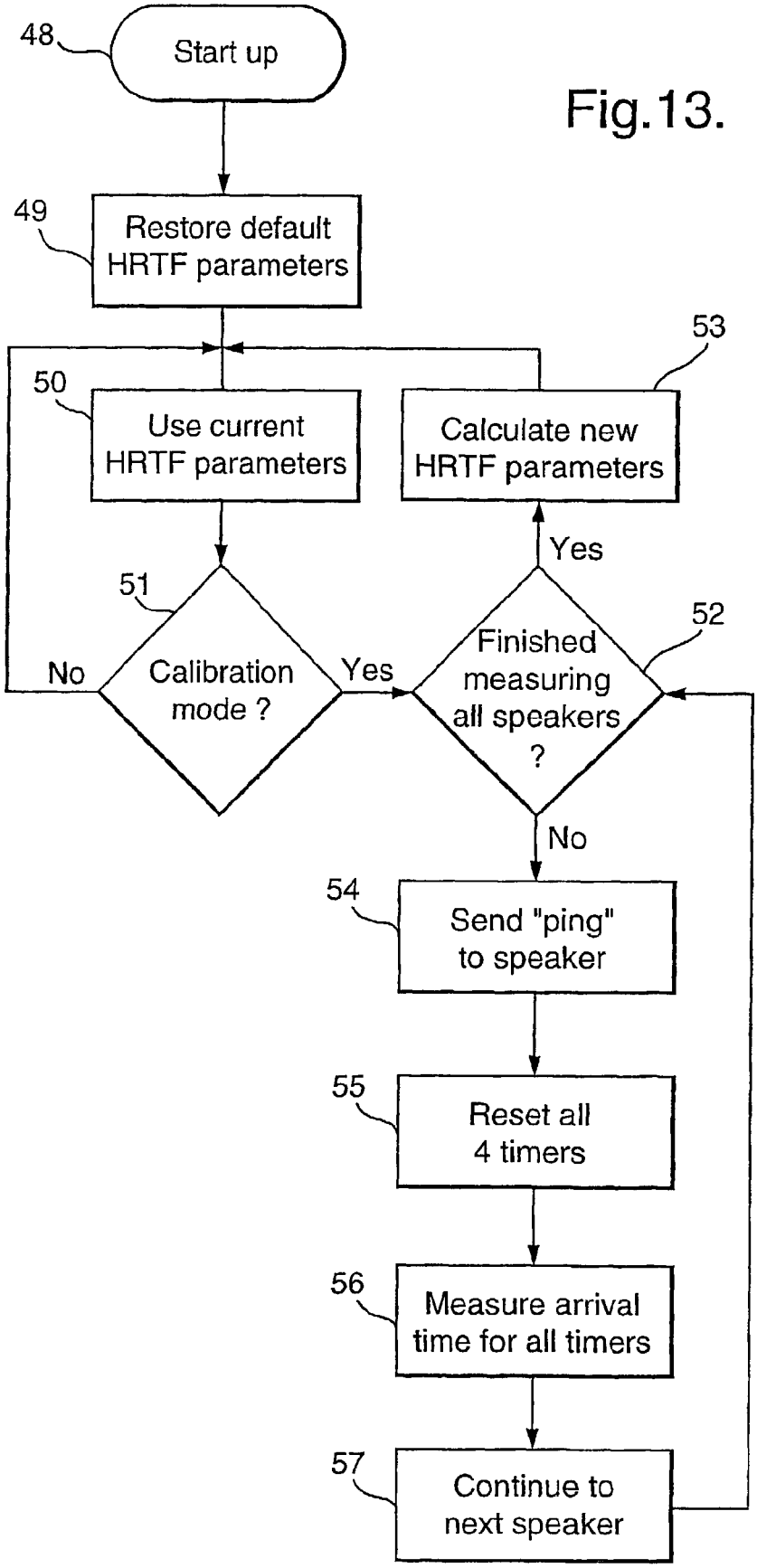

FIG. 13 is a flow chart illustrating the operation of the present invention.

DETAILED DESCRIPTION

Figure 1:
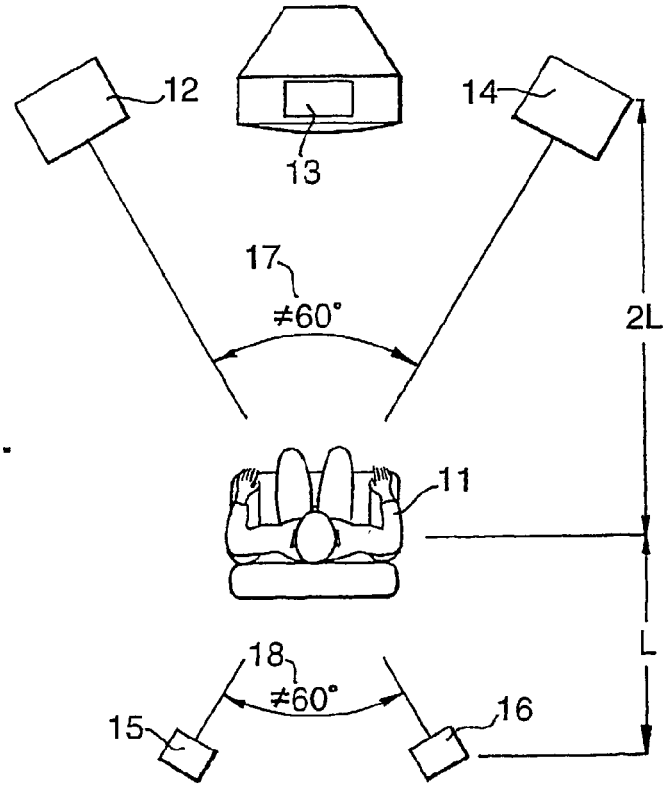

FIG. 1 illustrates an ideal positioning of a listener and loudspeakers, showing a listener 11 located within a typical surround system comprised of five speakers: front left speaker 12, center speaker 13, front right speaker 14, rear left speaker 15 and rear right speaker 16. In order to achieve the best surround effect, it is recommended that an angle 17 of 60° be kept between the front left speaker 12 and right front speaker 14. An identical angle 18 is recommended for the rear speakers 15 and 16. The listener should be facing the center speaker 13 at a distance 2L from the front speakers 12, 13, 14 and at a distance L from the rear speakers 15, 16. It should be noted that any deviation from the recommended position will diminish the surround experience.

It should be noted that the recommended position of the speakers might vary according to the selected surround protocol and the speaker manufacturer.

Figure 2:
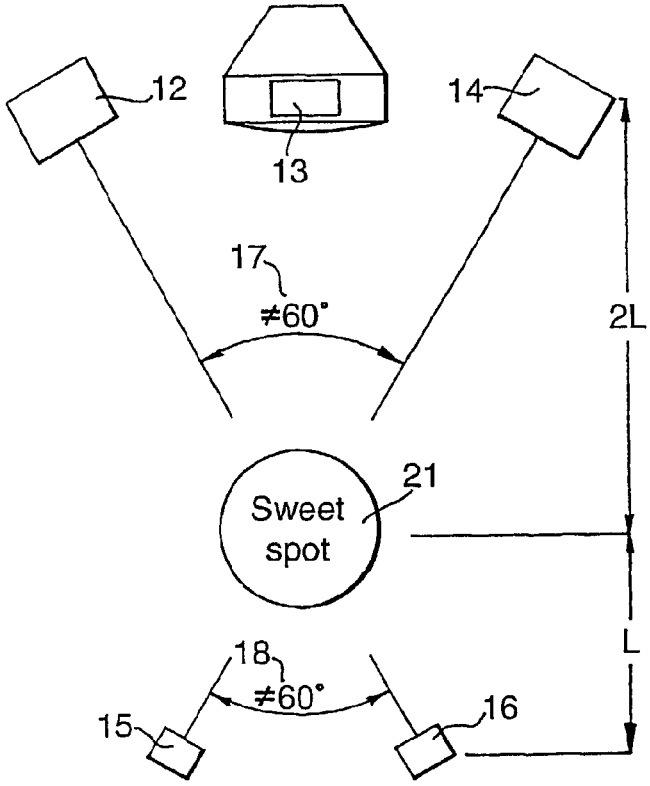

FIG. 2 illustrates the layout of FIG. 1, with a circle 21 representing the sweet spot. Circle 21 is the area in which the surround effect is best simulated. The sweet spot is symmetrically shaped, due to the fact that the speakers are placed in the recommended locations.

Figure 3:
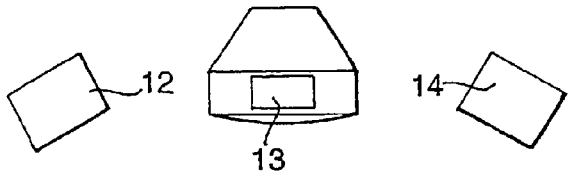

FIG. 3 describes a typical situation in which the listener 11 is aligned with the rear speakers 15 and 16. Listener 11 is located outside the sweet spot 22 and therefore will not enjoy the best surround effect possible. Sound that should have originated behind him will appear to be located on his left and right. In addition, the listener is sitting too close to the rear speaker, and hence experiences unbalanced volume levels.

Figure 4:
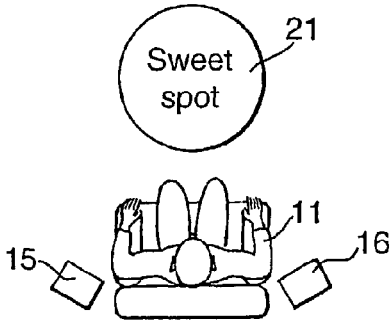
Figure 4:
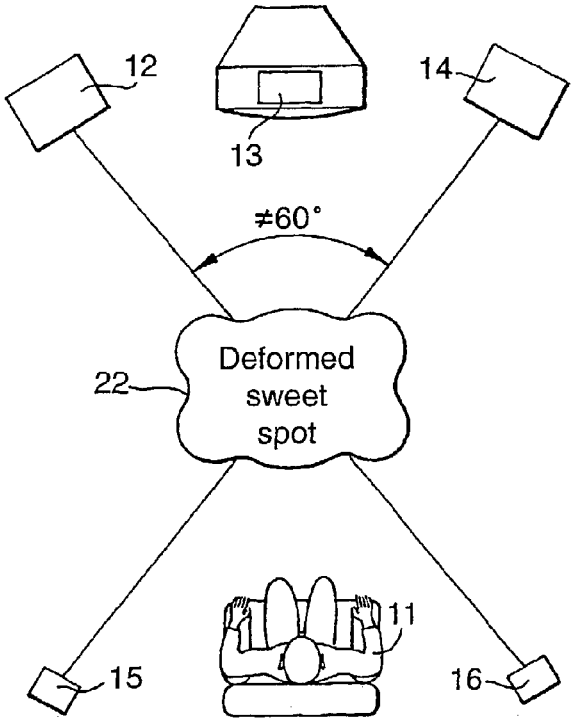

FIG. 4 illustrates misplacement of the rear speakers 15, 16, causing the sweet spot 22 to be deformed. A listener positioned in the deformed sweet spot would experience unbalanced volume levels and displacement of the sound field. The listener 11 in FIG. 4 is seated outside the deformed sweet spot.

Figure 5:
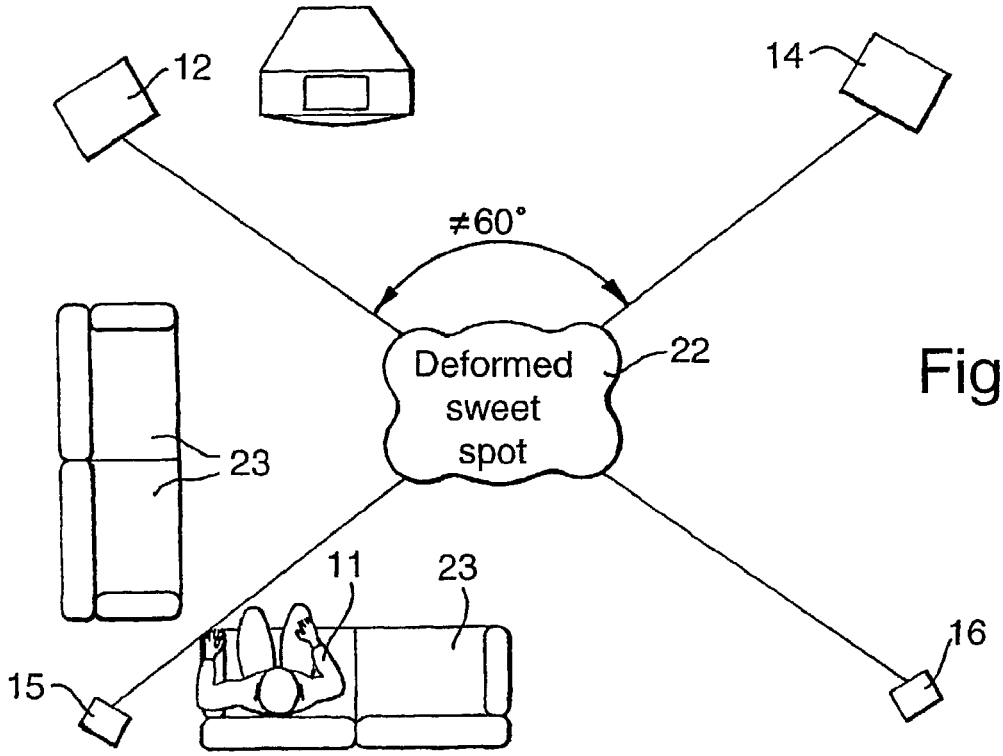

In FIG. 5, there is shown a typical surround room. The speakers 12, 14, 15 and 16 are misallocated, causing the sweet spot 22 to be deformed. Listener 11 is seated outside the sweet spot 22 and is too close to the left rear speaker 15. Such an arrangement causes a great degradation of the surround effect. None of the seats 23 is located within sweet spot 22.

Figure 6:
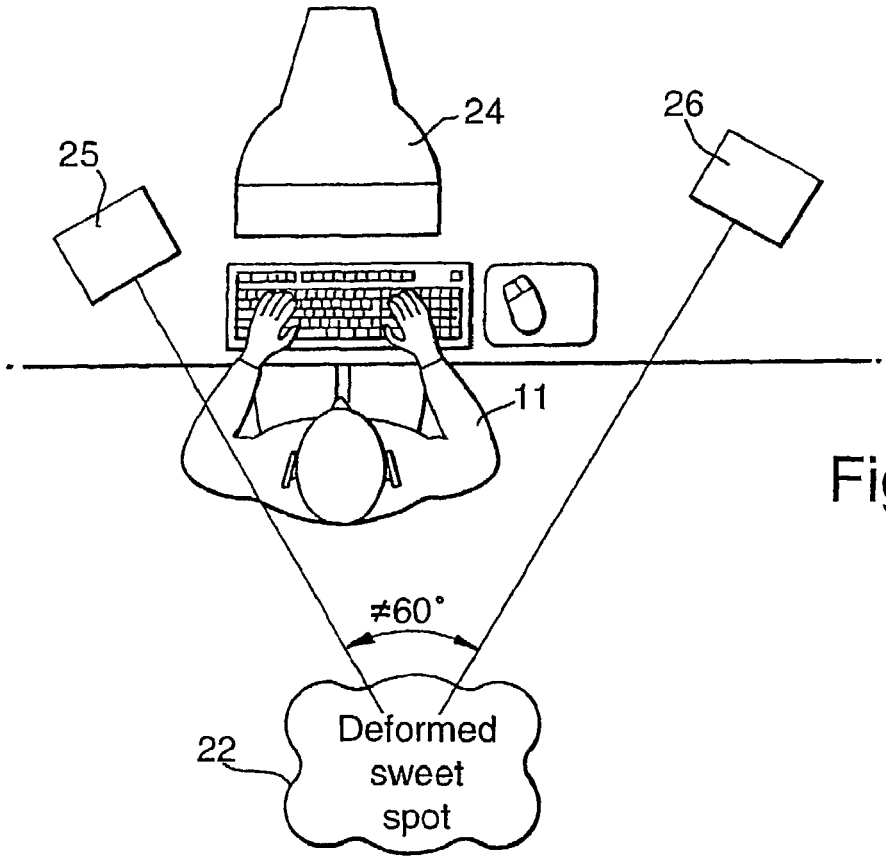

Shown in FIG. 6 is a typical PC environment. The listener II is using a two-speaker surround system for PC 24. The PC speakers 25 and 26 are misplaced, causing the sweet spot 22 to be deformed, and the listener is seated outside the sweet spot 22.

Figure 7:
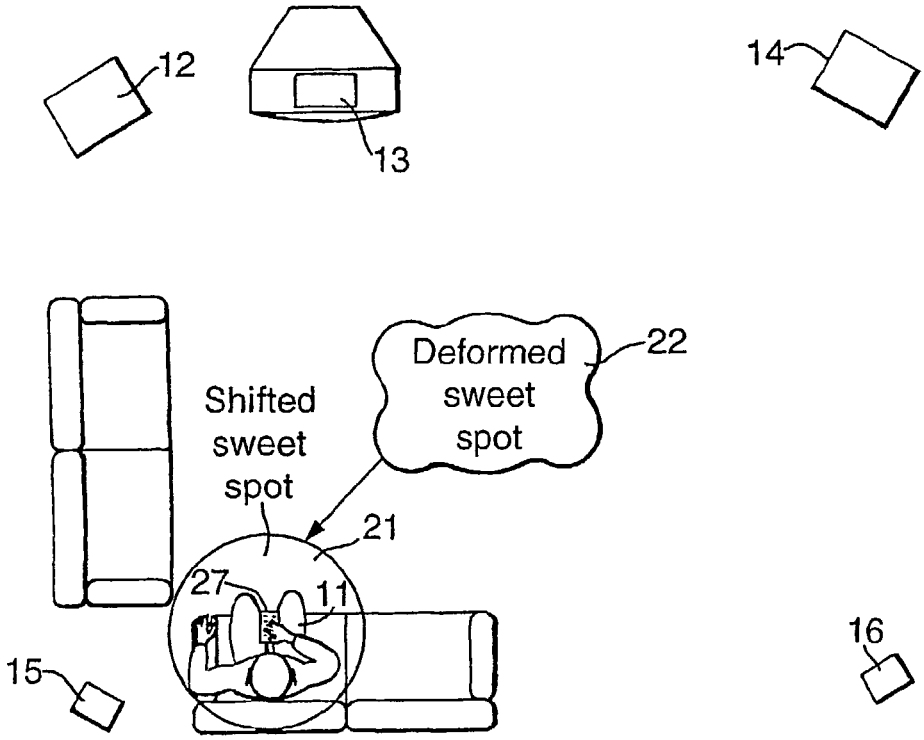

A preferred embodiment of the present invention is illustrated in FIG. 7. The position of the speakers 12, 13, 14, 15, 16 and the listening sweet spot are identical to those described with reference to FIG. 5. The difference is that the listener 11 is holding a remote position sensor 27 that accurately measures the position of the listener with respect to the speakers. Once the measurement is completed, the system manipulates the sound track of each speaker, causing the sweet spot to shift from its original location to the listening position. The sound manipulation also reshapes the sweet spot and restores the optimal listening experience. The listener has to perform such a calibration again only after changing seats or moving a speaker.

Remote position sensor 27 can also be used to measure the position of a resonating object. Placing the sensor near the resonating object can provide position information, later used to reduce the amount of energy arriving at the object. The processing unit can reduce the overall energy or the energy at specific frequencies in which the object is resonating.

The remote sensor 27 could also measure the impulse response of each of the speakers and analyze the transfer function of each speaker, as well as the acoustic characteristics of the room. The information could then be used by the processing unit to enhance the listening experience by compensating for non-linearity of the speakers and reducing unwanted echoes and/or reverberations.

Figure 8:
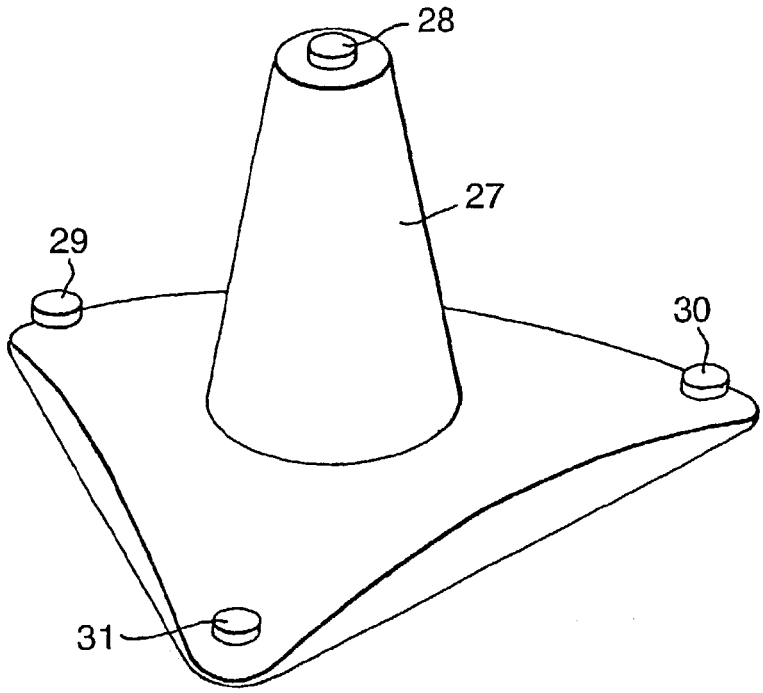

Seen in FIG. 8 is the remote position sensor 27, comprising an array of microphones or transducers 28, 29, 30, 31. The number and arrangement of microphones can vary, according to the designer's choice.

The measurement process for one of the speakers is illustrated in FIG. 9*a*. In order to measure the position, the system is switched to measurement mode. In this mode, a short sound ("ping") is generated by one of the speakers. The sound waves 32 propagate through the air at the speed of sound. The sound is received by the microphones 28, 29, 30 and 31, where Rx1 represents the relative distance between microphone 29 and the speaker which generated the sound ("ping"), Rx2 represents the relative distance between microphone 30 and the speaker, Rx3 represents the distance between microphone 31 and the speaker and Rx4 represents the distance between microphone 28 and the speaker. The distance and angle of the speaker determine the order and timing of the sound's reception.

FIG. 9*b* illustrates one "ping" as received by the microphones. The time T measured from the instant that "ping" is generated, say T0 and the time received by each of the microphones 29, 30, 28 and 31, respectively, is designated by T1, T2, T3 and T4. The measurement could be performed during normal playback, without interfering with the music. This is achieved by using a "ping" frequency, which is higher than human audible range (i.e., at 20,000 Hz). The microphones and electronics, however, would be sensitive to the "ping" frequency. The system could initiate several "pings" in different frequencies, from each of the speakers (e.g., one "ping" in the woofer range and one in the tweeter range). This method would enable the positioning of the tweeter or woofer in accordance with the position of the listener, thus enabling the system to adjust the levels of the speaker's component, and conveying an even better adjustment of the audio environment. Once the information is gathered, the system would use the same method to measure the distance and position of the other speakers in the room. At the end of the process, the system would switch back to playback mode.

It should be noted that, for simplicity of understanding, the described embodiment measures the location of one speaker at a time. However, the system is capable of measuring the positioning of multiple speakers simultaneously. One preferred embodiment would be to simultaneously transmit multiple "pings" from each of the multiple speakers, each with an unique frequency, phase or amplitude. The processing unit will be capable of identifying each of the multiple "pings" and simultaneously processing the location of each of the speakers.

A further analysis of the received signal can provide information on room acoustics, reflective surfaces, etc.

While for the sake of better understanding, the description herein refers to specifically generated "pings," it should be noted that the information required with respect to the distance and position of each of the speakers relative to the chosen sweet spot can just as well be gathered by analyzing the music played.

Turning now to FIG. 10, the different parameters measured by the system are demonstrated. Microphones 29, 30, 31 define a horizontal plane HP. Microphones 28 and 30 define the North Pole (NP) of the system. The location in space of any speaker 33 can be represented using three coordinates: R is the distance of the speaker, $\alpha$ is the azimuth with respect to NP, and $\epsilon$ is the angle or elevation coordinate above the horizon surface (HP).

FIG. 11 is a general block diagram of the system. The per se known media player 34 generates a multi-channel sound track. The processor 35 and remote position sensor 27 perform the measurements. Processor 35 manipulates the multi-channel sound track according to the measurement results, using HRTF parameters with respect to intensity, phase and/or equalization along with prior art signal processing algorithms. The manipulated multi-channel sound track is amplified, using a power amplifier 36. Each amplified channel of the multi-channel sound track is routed to the appropriate speaker 12 to 16. The remote position sensor 27 and processor 35 communicate, advantageously using a wireless channel. The nature of the communication channel may be determined by a skillful designer of the system, and may be wireless or by wire. Wireless communication may be carried out using infrared, radio, ultrasound, or any other method. The communication channel may be either bi-directional or uni-directional.

FIG. 12 shows a block diagram of a preferred embodiment of the processor 35 and remote position sensor 27. The processor's input is a multi-channel sound track 37. The matrix switch 38 can add "pings" to each of the channels, according to instructions of the central processing unit (CPU) 39. The filter and delay 40 applies HRTF algorithms to manipulate each sound track according to commands of the CPU 39. The output 41 of the system is a multi-channel sound track.

Signal generator 42 generates the "pings" with the desirable characteristics. The wireless units 43, 44 take care of the communication between the processing unit 35 and remote position sensor 27. The timing unit 45 measures the time elapsing between the emission of the "ping" by the speaker and its receipt by the microphone array 46. Upon receiving a first "ping", the timing unit 45 is set to 0 and measures the time elapsing between the transmission of the "ping" by the speaker and its receipt by each of the microphones in array 46. The timing measurements are analyzed by the CPU 39, which calculates the coordinates of each speaker (FIG. 10).

Due to the fact that room acoustics can change the characteristics of sound originated by the speakers, the test tones ("pings") will also be influenced by the acoustics. The microphone array 46 and remote position sensor 27 can measure such influences and process them, using CPU 39. Such information can then be used to further enhance the listening experience. This information could be used to reduce noise levels, better control of echoes, for automatic equalization, etc.

The number of outputs 41 of the multi-channels might vary from the number of input channels of sound track 37. The system could have, for example, multi-channel outputs and a mono- or stereo input, in which case an internal surround processor would generate additional spatial information according to predetermined instructions. The system could also use a composite surround channel input (for example, Dolby AC-3, Dolby Pro-Logic, DTS, THX, etc.), in which case a surround sound decoder is required.

The output 41 of the system could be a multi-channel sound track or a composite surround channel. In addition, a two-speaker surround system can be designed to use only two output channels to reproduce surround sound over two speakers.

Position information interface 47 enables the processor 35 to share position information with external equipment, such as a television, light dimmer switch, PC, air conditioner, etc.

An external device, using the position interface 47, could also control the processor. Such control could be desirable by PC programmers or movie directors. They would be able to change the virtual position of the speakers according to the artistic demands of the scene.

FIG. 13 illustrates a typical operation flow chart. Upon the system start up at 48, the system restores the default HRTF parameters 49. These parameters are the last parameters measured by the system, or the parameters stored by the manufacturer in the system's memory. When the system is turned on, meaning when music is played, the system uses its current HRTF parameters 50. When the system is switched into calibration mode 51, it checks if the calibration process is completed at 52. If the calibration process is completed, then the system calculates the new HRTF parameters 53 and replaces them with the default parameters 49. This can be done even during playback. The result is, of course, a shift of the sweet spot towards the listener's position and consequently, a correction of the deformed sound image. If the calibration process is not completed, the system sends a "ping" signal to one of the speakers 54 and, at the same time, resets all 4 timers 55. Using these timers, the system calculates at 56 the arrival time of the "ping" and according to it, calculates the exact location of the speaker in accordance with the listener's position. After the measurement of one speaker is finished, the system continues to the next one 57. Upon completion of the process for all of the speakers, the system calculates the calibrated HRTF parameters and replaces the default parameters with the calibrated ones.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The invention claimed is:

1. A system for optimization of three-dimensional audio listening having a media player and a multiplicity of speakers disposed within a listening space, said system comprising:

a portable sensor having a timing unit for receiving test signals from said speakers and for transmitting a signal based on said test signals to a processor connectable in the system, wherein said portable sensor has a multiplicity of transducers strategically arranged thereabout to define the disposition of each of said speakers, both in the horizontal plane as well as in elevation, with respect to the location of the portable sensor, said processor including:

a) means for initiating transmission of test signals to at least one of said speakers and to said timing unit for receiving said test signals from said speakers to be processed for determining the location of each of said speakers relative to a listening place within said space determined by the placement of said sensor;

b) means for manipulating each sound track of said multi-channel sound signals with respect to intensity, phase and/or equalization according to the relative location of each speaker in order to create virtual sound sources in desired positions, and c) means for communicating between said sensor and said processor.

2. The system as claimed in claim 1, wherein the test signals received by said sensor and the signal transmitted to said processor are at frequencies higher than the human audible range.

3. The system as claimed in claim 1, wherein said timing unit is operable to measure the time elapsing between the initiation of said test signals to each of said speakers and the time said test signals are received by said transducers.

4. The system as claimed in claim 1, wherein the communication between said sensor and said processor is wireless.

5. A method for the optimization of three-dimensional audio listening using a system including a media player, a multiplicity of speakers disposed within a listening space and a processor, said method comprising:

selecting a listener sweet spot within said listening space;

electronically determining the azimuth and elevation of the distance between said sweet spot and each of said speakers, and operating said speakers with respect to intensity, phase and/or equalization in accordance with its position relative to said sweet spot.

6. The method as claimed in claim 5, wherein the distance between said sweet spot and each of said speakers is determined by transmitting test signals to said speakers initiating a timing unit of a sensor for achieving synchronization between said sensor and said processor, receiving said signals by said sensor located at said sweet spot, measuring the time elapse between the initiation of said test signals to each of said speakers and the time said signals are received by said sensor, and transmitting said measurements to said processor.

7. The method as claimed in claim 6, wherein said test signals are transmitted at frequencies higher than the human audible range.

8. The method as claimed in claim 6, wherein said test signals are signals consisting of the music played.

9. The method as claimed in claim 6, wherein the transmission of said test signals is wireless.

10. The method as claimed in claim 6, wherein said sensor is operable to measure the impulse response of each of said speakers and to analyze the transfer function of each speaker, and to analyze the acoustic characteristics of the room.

11. The method as claimed in claim 10, wherein said measurements are processed to compensate for non-linearity of said speakers, to correct the frequency response of said speakers and to reduce unwanted echoes and/or reverberations to enhance the quality of the sound in the sweet spot.

12. A method for the optimization of three-dimensional audio listening using a system including a media player, a multiplicity of speakers disposed within a listening space and a processor, said method comprising:

providing a portable sensor for receiving test signals from said speakers and for transmitting a signal based on said test signals to a processor connectable in the system, said portable sensor having a multiplicity of transducers arranged thereabout to define the disposition of each of said speakers, both in the horizontal plane as well as in elevation, with respect to the location of the sensor, said processor including:

means for initiating transmission of test signals to each of said speakers and for receiving said test signals from said speakers to be processed for determining the location of each of said speakers relative to a listening place within said space determined by the placement of said sensor;

means for manipulating each sound track of said multichannel sound signals with respect to intensity, phase and/or equalization according to the relative location of each speaker in order to create virtual sound sources in desired positions, and means for communicating between said sensor and said processor;

selecting a listener sweet spot within said listening space;

electronically determining the azimuth and elevation of the distance between said sweet spot and each of said speakers, and operating said speakers with respect to intensity, phase and/or equalization in accordance with their positions relative to said sweet spot.

* * * * *